US009245394B2

(12) United States Patent
Park

(10) Patent No.: US 9,245,394 B2
(45) Date of Patent: Jan. 26, 2016

(54) DIAGNOSTIC SYSTEM AND METHOD FOR VEHICLE TERMINAL

(71) Applicant: HYUNDAI MOTOR COMPANY, Seoul (KR)

(72) Inventor: Jong Rae Park, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/522,552

(22) Filed: Oct. 23, 2014

(65) Prior Publication Data

US 2015/0310675 A1 Oct. 29, 2015

(30) Foreign Application Priority Data

Apr. 25, 2014 (KR) ..... 10-2014-0050301

(51) Int. Cl.
*G07C 5/00* (2006.01)

(52) U.S. Cl.
CPC ..... *G07C 5/008* (2013.01)

(58) Field of Classification Search
USPC ..... 701/31.5
See application file for complete search history.

(56) References Cited

U.S. PATENT DOCUMENTS 6,745,151 B2 * 6/2004 Marko et al. ..... 702/182
7,117,075 B1 * 10/2006 Larschan et al. ..... 701/29.6
8,297,384 B2 * 10/2012 Wanger et al. ..... 180/14.2
8,467,735 B2 * 6/2013 Giles et al. ..... 455/67.11
8,744,390 B2 * 6/2014 Stratford ..... 455/226.1
8,839,224 B2 * 9/2014 Adler et al. ..... 717/168
2010/0234071 A1 * 9/2010 Shabtay et al. ..... 455/562.1
2012/0329445 A1 12/2012 Elliott
2013/0345926 A1 * 12/2013 Boulton et al. ..... 701/32.8
2014/0309847 A1 * 10/2014 Ricci ..... 701/33.1

FOREIGN PATENT DOCUMENTS

JP 58-149145 A 9/1983
JP 2006-031118 A 2/2006
KR 10-2003-0068328 A 8/2003
KR 10-2010-0064758 A 6/2010
KR 10-2013-0063379 A 6/2013

* cited by examiner

*Primary Examiner* — Hussein Elchanti
*Assistant Examiner* — Alex C Dunn
(74) *Attorney, Agent, or Firm* — McDermott Will & Emery LLP

(57) ABSTRACT

A system for diagnosing a vehicle terminal includes a WiFi dongle coupled to an external connection terminal of a vehicle to connect wireless communication between a vehicle diagnosis device and the vehicle terminal. A vehicle diagnosis device is configured to transmit an inspection start command to the vehicle terminal through the WiFi dongle, and inspect at least one of a Bluetooth function and a voice recognition function. The vehicle terminal is configured to download and store phone book data through Bluetooth paired with the vehicle diagnosis device, detect a phone book name in the stored phone book data, and enter a call making mode. The vehicle diagnosis device inspects the Bluetooth function according to whether the phone book data of the vehicle terminal is downloaded, and inspects the voice recognition function.

20 Claims, 4 Drawing Sheets

DIAGNOSTIC SYSTEM AND METHOD FOR VEHICLE TERMINAL

CROSS-REFERENCE TO RELATED APPLICATION

This application claims the benefit of priority to Korean Patent Application No. 10-2014-0050301 filed in the Korean Intellectual Property Office on Apr. 25, 2014, the entire contents of which are incorporated herein by reference.

TECHNICAL FIELD

The present disclosure relates to a diagnostic system and method for a vehicle terminal, and more particularly, to a system and a method of diagnosing Bluetooth and voice recognition of a multimedia terminal for a vehicle assembled in a plant.

BACKGROUND

A vehicle assembly plant inspects whether a main function of a multimedia terminal for a vehicle (audio, video, and navigation (AVN), hereinafter, referred to as "a vehicle terminal" for convenience) is operated normally after in-line assembling. Particularly, a quality problem is generated in a Bluetooth function or a voice recognition function, which is a main function of the vehicle terminal, such that the vehicle needs to be inspected before being delivered.

In general, when the vehicle is assembled in the assembly line, an operator performs a visual inspection in order to inspect a functional operation of the vehicle terminal (Audio/AVN).

For example, in an existing vehicle assembly plant, in order to inspect Bluetooth of the vehicle terminal, an operator (inspector) manually pairs and connects with a mobile phone and directly executes music streaming to inspect whether the Bluetooth is operated normally.

Further, in order to inspect voice recognition, the operator presses a voice recognition button included in a steering wheel remote control, and checks whether the voice recognition function is operated normally by speaking a representative voice recognition command.

However, since a Bluetooth function and a voice recognition function are optionally provided to an audio product applied to the vehicle terminal, functions thereof may be differently applied, and thus, it may be unclear for the operator to know which function is needed.

That is, in a method of inspecting a function of a vehicle terminal in the related art, the inspection may be improperly performed due to a human error, such as a misconduct or check omission of the operator, and a production lead time is increased due to a manual inspection method, thereby degrading the production efficiency.

The above information disclosed in this Background section is only for enhancement of understanding of the background of the invention, and therefore, it may contain information that does not form the prior art that is already known in this country to a person of ordinary skill in the art.

SUMMARY

The present disclosure has been made in an effort to provide a system and a method of diagnosing a vehicle terminal, which automatically diagnose a Bluetooth function and a voice recognition function according to a diagnosis program by setting communication with a vehicle terminal assembled in a factory.

According to an exemplary embodiment of the present inventive concept, a system for diagnosing a vehicle terminal which is a multimedia product assembled in a vehicle assembly plant includes a WiFi dongle coupled to an external connection terminal of a vehicle to connect wireless communication between a vehicle diagnosis device and the vehicle terminal. The vehicle diagnosis device is configured to transmits an inspection start command to the vehicle terminal through the WiFi dongle, and inspect at least one of a Bluetooth function and a voice recognition function in consideration of system information received from the vehicle terminal. The vehicle terminal is configured to download and store phone book data through Bluetooth paired with the vehicle diagnosis device, detect a phone book name spoken with a voice from the vehicle diagnosis device in the stored phone book data, and enter a call making mode. The vehicle diagnosis device inspects the Bluetooth function according to whether the phone book data of the vehicle terminal is downloaded, and inspects the voice recognition function according to whether the vehicle terminal enters the call making mode.

According to another exemplary embodiment of the present inventive concept, a method of diagnosing, by a vehicle diagnosis device, a vehicle terminal which is a multimedia product assembled in a vehicle assembly plant, includes connecting wireless communication with the vehicle terminal through a WiFi dongle coupled to an external connection terminal of a vehicle, and transmitting an inspection start command to the vehicle terminal. Bluetooth is connected according to a request of the vehicle terminal, and stored phone book data is transmitted to the vehicle terminal through Bluetooth communication. An inspection of the Bluetooth is determined to be successful when a phone book data reception completion message is received from the vehicle terminal. A phone book name is searched for a call making command through a voice output speaker, and an inspection of the voice recognition function is determined to be successful when the vehicle terminal detects the phone book name from the phone book data and enters a call making mode.

According to yet another exemplary embodiment of the present inventive concept, a method of diagnosing a Bluetooth function and a voice recognition function by interconnecting a vehicle terminal, which is a multimedia product assembled in a vehicle assembly plant with a vehicle diagnosis device includes receiving, by the vehicle terminal, an inspection start command from a vehicle diagnosis device connected through a WiFi dongle, and initiating a diagnosis mode. A vehicle diagnosis device and a Mac address stored in a system for diagnosing the vehicle terminal are detected, Bluetooth pairing with the vehicle diagnosis device is requested through the detected Mac address, and the vehicle diagnosis device and the Bluetooth are connected. Phone book data transmitted from the vehicle diagnosis device is downloaded and stored through Bluetooth communication, and a phone book data reception completion message is transmitted. A phone book name spoken by the vehicle diagnosis device is recognized and the recognized phone book name in the stored phone book data is searched. A result of a success of entrance to a call making mode is transmitted by using a telephone number of the phone book name to the vehicle diagnosis device.

According to the exemplary embodiments of the present inventive concept, a diagnosing terminal and a vehicle terminal are interconnected according to a set diagnosis program and automatically inspect the Bluetooth function and the voice recognition function by simply connecting the diagnosing terminal and the vehicle terminal of a vehicle entering an inspection line through a WiFi dongle, so that it is possible to remarkably reduce a human error by an operator.

Since the vehicle diagnosis device automatically performs the diagnosis inspection in consideration of the system information on the vehicle terminal, it is possible to decrease the production lead time, and improve the production efficiency.

Further, it is possible to inspect a hands-free function of the vehicle terminal by utilizing the phone book data transmission and the call making function for inspecting the Bluetooth function and the voice recognition function.

DETAILED DESCRIPTION

Figure 1:
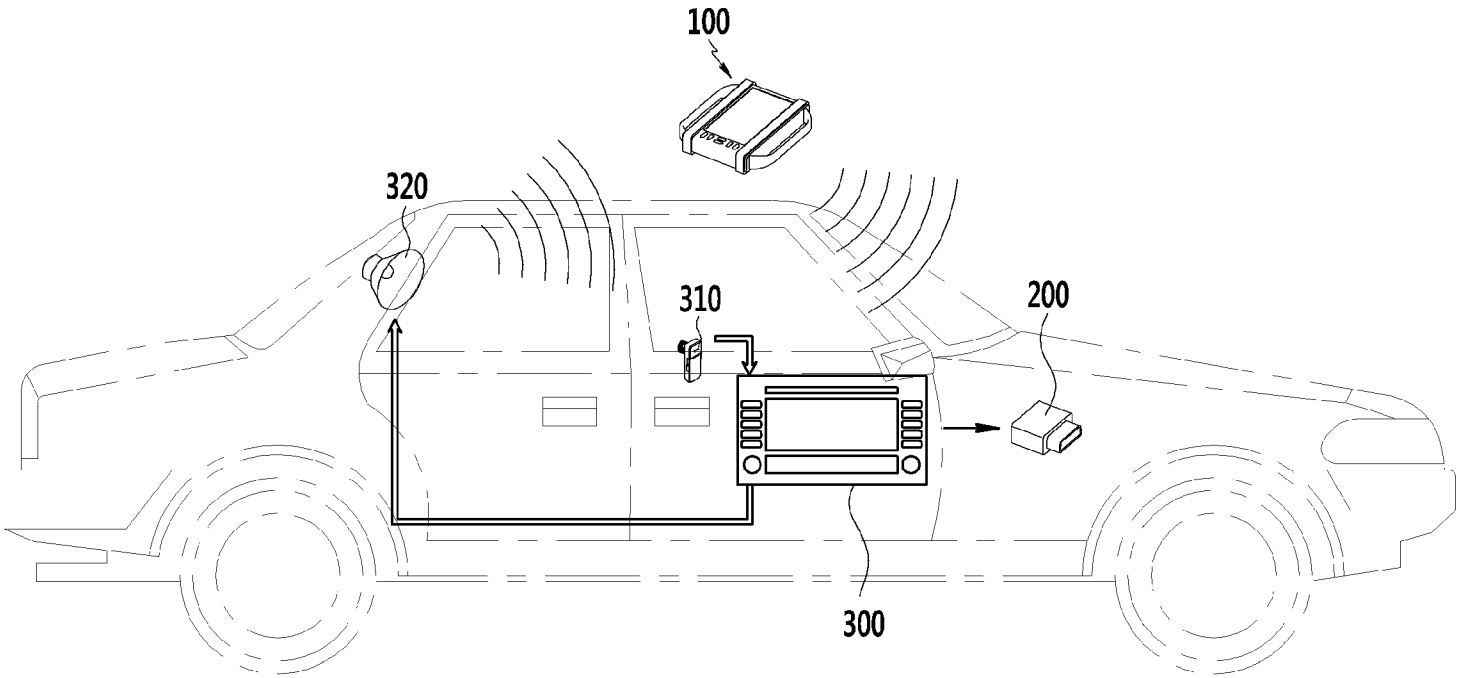
FIG. 1 is a diagram schematically illustrating a configuration of a diagnosis system for a vehicle terminal.

In the following detailed description, only certain exemplary embodiments of the present inventive concept have been shown and described, simply by way of illustration. As those skilled in the art would realize, the described embodiments may be modified in various different ways, all without departing from the spirit or scope of the present inventive concept. Accordingly, the drawings and description are to be regarded as illustrative in nature and not restrictive. Like reference numerals designate like elements throughout the specification.

Through the specification, unless explicitly described to the contrary, the word "comprise" and variations such as "comprises" or "comprising" will be understood to imply the inclusion of stated elements but not the exclusion of any other elements. In addition, the terms "-er," "-or," and "module" described in the specification mean units for processing at least one function and operation and can be implemented by hardware components or software components and combinations thereof.

Hereinafter, a system and a method of diagnosing a vehicle terminal according to an exemplary embodiment of the present inventive concept will be described in detail with reference to the accompanying drawings.

FIG. 1 schematically illustrates a configuration of a diagnosis system for a vehicle terminal.

Referring to FIG. 1, a diagnosis system for a vehicle terminal according to an exemplary embodiment of the present inventive concept includes a vehicle diagnosis device 100, a WiFi dongle 200, a vehicle terminal 300, a vehicle microphone 310, and a vehicle speaker 320.

When a vehicle, which is preassembled, enters an inspection line for a completed car inspection, the vehicle diagnosis device 100 connects near field wireless communication with the vehicle terminal 300 through the WiFi dongle 200, transmits an inspection start command to the vehicle terminal 300, and starts a diagnosis of Bluetooth and voice recognition.

The vehicle diagnosis device 100 is configured by information devices including a WiFi communication module, a Bluetooth module, a wired input/output module, a voice output speaker, a touch screen, a memory, and a vehicle diagnosis application, which are not illustrated in the drawing.

Figure 2:
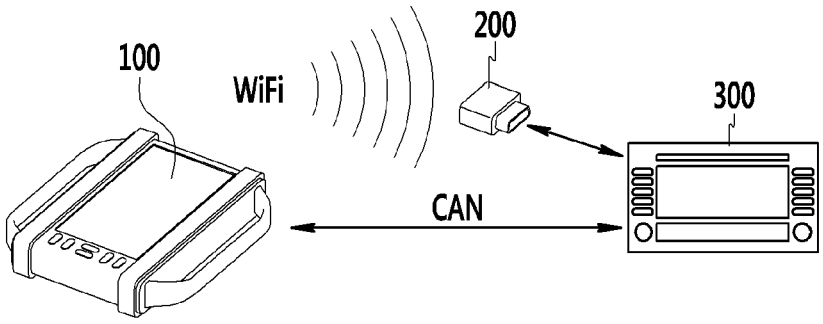
FIG. 2 is a diagram illustrating a method of connecting communication with a vehicle diagnosis device for diagnosing a vehicle terminal according to an exemplary embodiment of the present inventive concept.

FIG. 2 illustrates a method of connecting communication with a vehicle diagnosis device for diagnosing a vehicle terminal according to an exemplary embodiment of the present inventive concept.

Referring to FIG. 2, the wireless dongle 200 is a wireless on-board diagnostics (OBD) USB dongle, and coupled to an OBD terminal of the vehicle entering the inspection line by an operator to connect communication between the vehicle diagnosis device 100 and the vehicle terminal 300.

In the exemplary embodiment of the present inventive concept, the communication between the vehicle diagnosis device 100 and the vehicle terminal 300 is wirelessly connected by using the WiFi dongle 200, but the present disclosure is not limited thereto. The communication between the vehicle diagnosis device 100 and the vehicle terminal 300 may be connected by wire through the OBD terminal. That is, when the WiFi dongle 200 is not present, the vehicle diagnosis device 100 may transmit an inspection start command through a wired cable connected to the OBD terminal and initiate a diagnosis of a Bluetooth/voice recognition.

When the vehicle terminal 300 receives the inspection start command through CAN communication of the OBD terminal, the vehicle terminal 300 immediately changes to a diagnosis mode of at least one of the Bluetooth and the voice recognition and transmits system information on the vehicle terminal 300 to the vehicle diagnosis device 100 through the WiFi dongle 200. The vehicle terminal 300 may pre-store a diagnosis program in a system, and perform the diagnosis of the Bluetooth and the voice recognition through a linkage with the vehicle diagnosis device 100 according to the inspection start command.

Here, the system information is transmitted with 4 bits, and for example, the first bit may include multimedia (Audio/AVN) product classification information, the second bit may include classification information on a basic language (for example, Korean, English, Japanese, and Chinese) applied to a multimedia product, the third bit may include Bluetooth inspection application classification information, and the fourth bit may include voice recognition inspection application classification information. Since the basic language and an optional function are various according to domestic consumption, export consumption, and the type of the multimedia product even though vehicles preassembled are the same type, the system information is used to make the various basic used languages and optional functions recognized by the vehicle diagnosis device 100.

Further, the system information is output through the vehicle speaker 320 through text to speech (TTS), so that the operator may recognize the system information on the inspection target vehicle terminal 300.

The vehicle diagnosis device 100 receives and recognizes the system information from the vehicle terminal 300 receiving the Bluetooth inspection start command, and then performs the diagnosis of the Bluetooth or the voice recognition appropriate to the corresponding system information.

The vehicle terminal 300 matches a list of the vehicle diagnosis devices 100 used in the assembly plant and Mac addresses, stores the matched vehicle diagnosis devices 100 and the Mac addresses, and searches for the vehicle diagnosis device 100 stored in the list through the Mac address to perform Bluetooth pairing when the diagnosis mode starts.

When the vehicle diagnosis device 100 is connected through the Bluetooth, the vehicle diagnosis device 100 transmits phone book data to the vehicle terminal 300 through the connected Bluetooth communication, and when the vehicle diagnosis device 100 confirms that the phone book data is completely downloaded from the vehicle terminal 300, the vehicle diagnosis device 100 determines that the Bluetooth function is normal. In this case, the phone book data includes at least one phone book name (for example, HONG, Gil-Dong) and a telephone number (010-XXXX-YYYY) necessary for inspecting the voice recognition later.

When the vehicle terminal 300 receives the voice recognition inspection start command from the vehicle diagnosis device 100, the vehicle terminal 300 switches to a voice recognition standby mode, and then recognizes a phone book name (for example, HONG, Gil-Dong) through a speaker of the vehicle diagnosis device 100. The vehicle terminal 300 detects the phone book name from the phone book data and executes a call making mode. In this case, when the vehicle diagnosis device 100 confirms that the vehicle terminal 300 attempts to make the call making mode (call) with the telephone number (010-XXXX-YYYY) of the spoken phone book name, the vehicle diagnosis device 100 determines that the voice recognition function is normal.

A method of diagnosing the Bluetooth function and the voice recognition function of the vehicle terminal 300 according to the exemplary embodiment of the present inventive concept will be described with reference to FIGS. 3 and 4.

Figure 3:
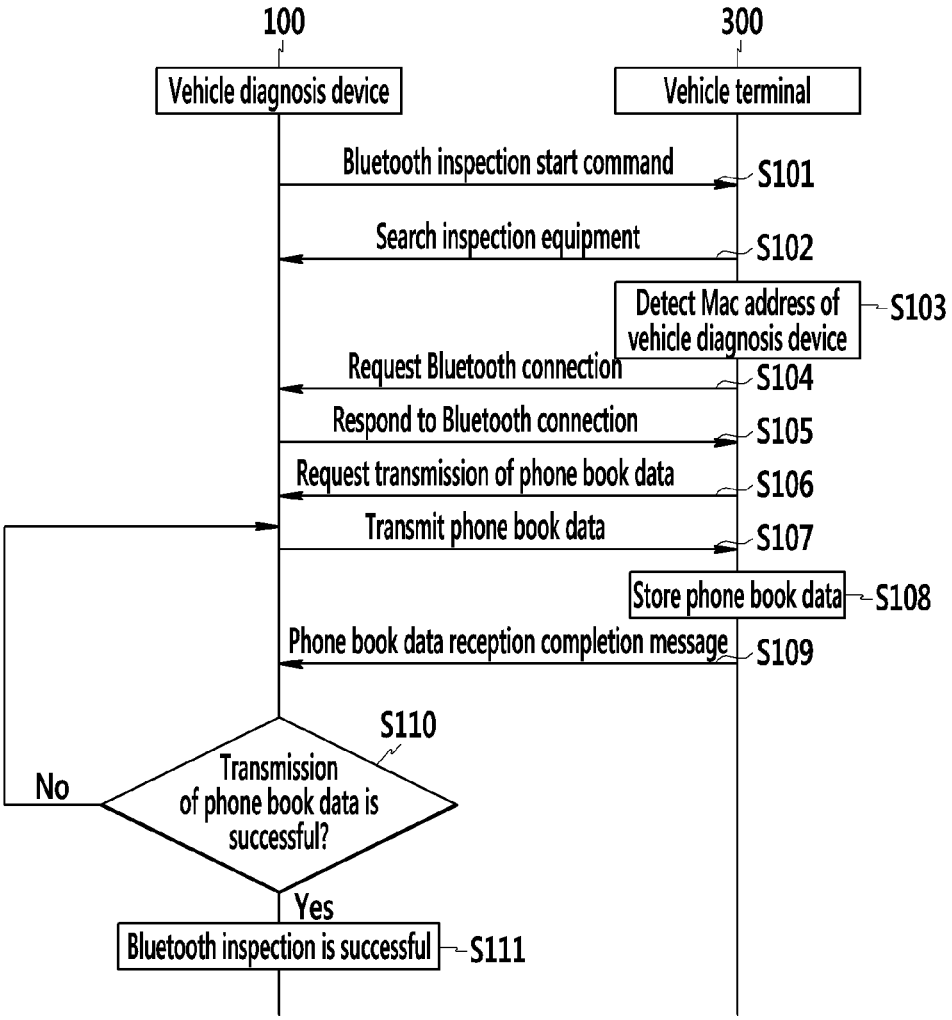
FIG. 3 is a flowchart schematically illustrating a method of diagnosing Bluetooth according to an exemplary embodiment of the present inventive concept.

FIG. 3 is a flowchart schematically illustrating a method of diagnosing the Bluetooth according to an exemplary embodiment of the present inventive concept.

Referring to FIG. 3, the vehicle diagnosis device 100 according to the exemplary embodiment of the present inventive concept connects communication with the vehicle terminal 300 through the WiFi dongle 200, and transmits an inspection start command (S101).

When the vehicle terminal 300 receives the inspection start command, the vehicle terminal 300 changes a mode to the Bluetooth diagnosis mode and searches for the vehicle diagnosis device 100 (S102), and detects the vehicle diagnosis device 100 stored in the system and a MAC address of the vehicle diagnosis device 100 (S103). In this case, when the vehicle terminal 300 does not store the MAC address, the vehicle terminal 300 may directly receive and store the MAC address through the inspection start command received from the vehicle diagnosis device 100, and then searches for the vehicle diagnosis device 100.

When the vehicle terminal 300 requests for Bluetooth pairing and connection with the vehicle diagnosis device 100 through the detected MAC address (S104). In this case, although omitted in the drawing, the vehicle terminal 300 may re-attempt the Bluetooth connection by a maximum of 3 times when the Bluetooth connection fails.

When the vehicle diagnosis device 100 receives the Bluetooth connection request from the vehicle terminal 300, the vehicle diagnosis device 100 responds to the Bluetooth connection (S105).

When the vehicle terminal 300 is connected with the vehicle diagnosis device 100 through the Bluetooth, the vehicle terminal 300 requests transmission of phone book data through the connected Bluetooth communication (S106), and downloads the phone book data transmitted from the vehicle diagnosis device 100 (S107).

The vehicle terminal 300 stores the downloaded phone book data (S108), and transmits a reception completion message of the phone book data to the vehicle diagnosis device 100 (S109). In this case, the phone book data includes a phone book name and a telephone number for at least one language, for example, may include one Korean phone book name and one English phone book name.

When the vehicle diagnosis device 100 receives the reception completion message of the phone book data from the vehicle terminal 300 and confirms that the phone book data is successfully transmitted through the Bluetooth (S110), the vehicle diagnosis device 100 determines that a normal Bluetooth inspection is successful (S111).

When the vehicle diagnosis device 100 determines that the transmission of the phone book data is failed, the vehicle diagnosis device 100 notifies the failure of the transmission of the phone book data, and re-performs operation S106 and re-transmits the phone book data.

Then, although not illustrated in the drawing, the vehicle diagnosis device 100 may store vehicle identification information on the diagnosed vehicle or identification information on the vehicle terminal 300, and a success/failure history of the Bluetooth inspection.

Figure 4:
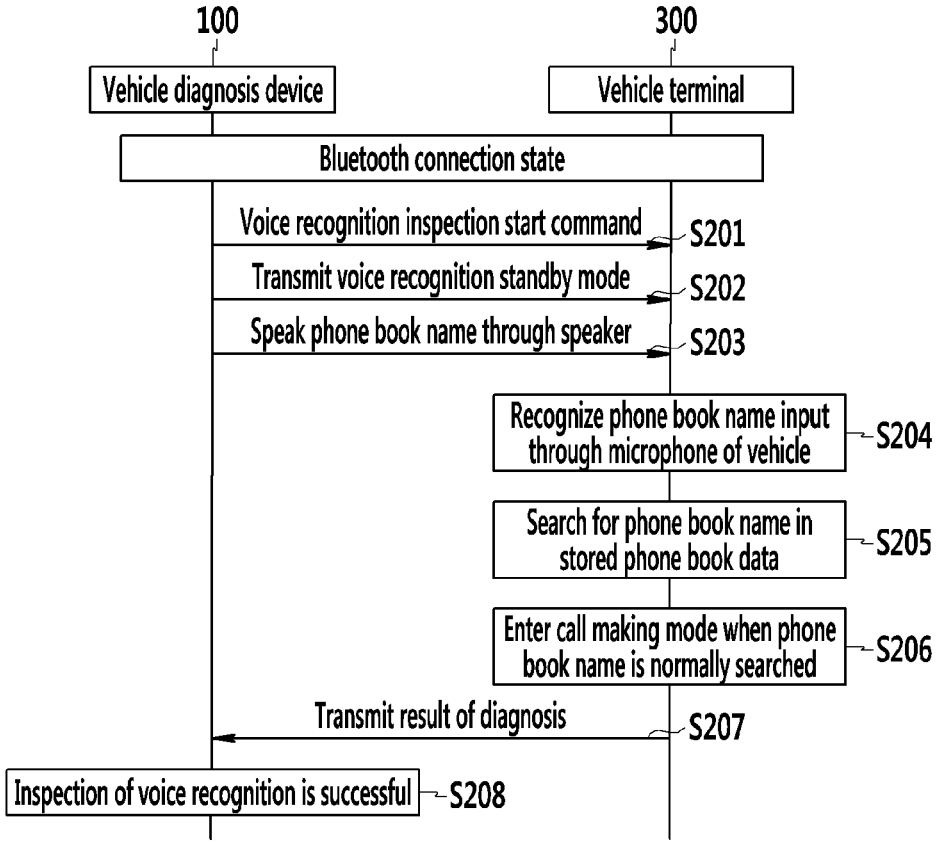
FIG. 4 is a flowchart schematically illustrating a method of diagnosing voice recognition according to an exemplary embodiment of the present inventive concept.

FIG. 4 is a flowchart schematically illustrating a method of diagnosing voice recognition according to an exemplary embodiment of the present inventive concept.

Referring to FIG. 4, a method of diagnosing voice recognition according to an exemplary embodiment of the present inventive concept is performed in a state where the Bluetooth is in connection with the aforementioned performance of the Bluetooth diagnosis.

The vehicle diagnosis device 100 transmits a voice recognition inspection start command to the vehicle terminal 300 (S201).

When the vehicle terminal 300 receives the voice recognition inspection start command, the vehicle terminal 300 enters a voice recognition standby mode and transmits a voice recognition standby mode state to the vehicle diagnosis device (S202). In this case, when a first Bluetooth and voice recognition inspection command is reserved in operation S101 of FIG. 3, operation S201 can be omitted, and the vehicle terminal 300 may automatically enter the voice recognition standby mode after a Bluetooth inspection is completed.

When the vehicle terminal 300 enters the voice recognition standby mode, the vehicle diagnosis device 100 speaks a phone book name for a call making command through a voice output speaker (S203). In this case, the vehicle diagnosis device 100 may speak a Korean phone book name when the basic language is Korean, and speak an English phone book name when the basic language is English in consideration of the system information of the vehicle terminal 300.

The vehicle terminal 300 recognizes the phone book name input through the vehicle microphone 310 (S204), and searches for the recognized phone book name in the stored phone book data (S205).

Further, when the phone book name is normally searched in the phone book data, the vehicle terminal 300 enters the call making mode by using a telephone number of the corresponding phone book name (S206), and transmits a result of the entrance of the call making mode to the vehicle diagnosis device 100 (S207).

Then, when the vehicle diagnosis device 100 receives the result of the success of the entrance of the call making mode by using the phone book data, the vehicle diagnosis device 100 determines that the inspection of the voice recognition is successful, and stores an inspection history and terminates the diagnosis inspection of the vehicle terminal 300 (S208). In this case, the vehicle terminal 300 may automatically delete the stored phone book data for the Bluetooth and voice recognition diagnosis after the termination of the diagnosis inspection, and remove a test trace.

As described above, according to the exemplary embodiment of the present inventive concept, a diagnosing terminal and a vehicle terminal are interconnected according to a set diagnosis program and automatically inspect the Bluetooth function and the voice recognition function by simply connecting the diagnosing terminal and the vehicle terminal of a vehicle entering an inspection line through the WiFi dongle, so that it is possible to remarkably reduce an operator human error.

Since the vehicle diagnosis device automatically performs the diagnosis inspection in consideration of the system information on the vehicle terminal, it is possible to decrease a production lead time due to an existing manual inspection method, and improve production efficiency.

In addition, it is possible to further inspect a hands-free function of the vehicle terminal by utilizing the phone book data transmission and the call making function for inspecting the Bluetooth function and the voice recognition function.

The exemplary embodiment of the present inventive concept is not only implemented by the aforementioned apparatus and/or method, but also may be implemented by a program for implementing a function corresponding to the configuration of the exemplary embodiment of the present inventive concept, a recording medium in which the program is recorded, and the like, and the implementation may be easily realized from the description of the aforementioned exemplary embodiment by those skilled in the art.

While this invention has been described in connection with what is presently considered to be practical exemplary embodiments, it is to be understood that the invention is not limited to the disclosed embodiments, but on the contrary, is intended to cover various modifications and equivalent arrangements included within the spirit and scope of the appended claims.

What is claimed is:

1. A system for diagnosing a vehicle terminal which is a multimedia product assembled in a vehicle assembly plant, the system comprising:

an IEEE 802.11 dongle coupled to an external connection terminal of a vehicle to connect wireless communication between a vehicle diagnosis device and the vehicle terminal, wherein the vehicle diagnosis device is configured to transmit an inspection start command to the vehicle terminal through the IEEE 802.11 dongle and to inspect at least one of an IEEE 802.15.1 function and a voice recognition function in consideration of system information received from the vehicle terminal, the vehicle terminal is configured to download and store phone book data through IEEE 802.15.1 paired with the vehicle diagnosis device, to detect a phone book name spoken with a voice from the vehicle diagnosis device in the stored phone book data, and to enter a call making mode, and wherein the vehicle diagnosis device inspects the IEEE 802.15.1 function according to whether the phone book data of the vehicle terminal is downloaded, and inspects the voice recognition function according to whether the vehicle terminal enters the call making mode.

2. The system of claim 1, wherein the system information includes at least one of multimedia product classification information, classification information on a basic language applied to a multimedia product, IEEE 802.15.1 inspection application classification information, and voice recognition inspection application classification information.

3. The system of claim 1, wherein the vehicle diagnosis device provides the phone book name appropriate to a corresponding language through a voice speaker with reference to classification information on a basic language applied to the system information.

4. The system of claim 1, wherein the vehicle diagnosis device transmits the phone book data to the vehicle terminal when the IEEE 802.15.1 is connected with the vehicle terminal through pairing.

5. The system of claim 1, wherein the vehicle terminal matches a list of vehicle diagnosis devices used in the vehicle assembly plant with Mac addresses and stores the matched vehicle diagnosis devices and the Mac addresses, and performs IEEE 802.15.1 pairing with the vehicle diagnosis device through the Mac addresses stored in the list.

6. The system of claim 1, wherein when the vehicle terminal receives a voice recognition inspection start command from the vehicle diagnosis device, the vehicle terminal switches to a voice recognition standby mode, recognizes the phone book name spoken by the vehicle diagnosis device, and detects the phone book name from the phone book data.

7. The system of claim 1, wherein the vehicle diagnosis device transmits the inspection start command to the vehicle terminal through a wired cable connected to an on-board diagnostics (OBD) terminal, and initiates the diagnosis of the IEEE 802.15.1 and the voice recognition function.

8. The system of claim 2, wherein the multimedia product classification information includes audio, video, and navigation (AVN) information.

9. The system of claim 2, wherein the vehicle diagnosis device provides the phone book name appropriate to a corresponding language through a voice speaker with reference to the classification information on the basic language applied to the system information.

10. A method of diagnosing a vehicle terminal which is a multimedia product assembled in a vehicle assembly plant by a vehicle diagnosis device, the method comprising steps of:

a) connecting wireless communication with the vehicle terminal through an IEEE 802.11 dongle coupled to an external connection terminal of a vehicle, and transmitting an inspection start command to the vehicle terminal;

b) connecting to IEEE 802.15.1 according to a request of the vehicle terminal, and transmitting stored phone book data to the vehicle terminal through IEEE 802.15.1 communication;

c) determining that an inspection of the IEEE 802.15.1 is successful when receiving a phone book data reception completion message from the vehicle terminal; and d) speaking a phone book name for a call making command through a voice output speaker, and determining that an inspection of the voice recognition function is successful when the vehicle terminal detects the phone book name from the phone book data and enters a call making mode.

11. The method of claim 10, wherein step a) includes:

recognizing information on a basic language applied to a multimedia product, and whether the inspection of the IEEE 802.15.1 or the voice recognition is applied based on system information received from the vehicle terminal.

12. The method of claim 10, wherein step d) includes:

selecting and speaking the phone book name according to a basic language applied to the vehicle terminal among phone book names stored in the phone book data.

13. The method of claim 10, further comprising after step (d):

storing vehicle identification information on a diagnosed vehicle or identification information and an inspection history of the vehicle terminal.

14. The method of claim 11, wherein step d) includes:

selecting and speaking the phone book name according to the basic language applied to the vehicle terminal among phone book names stored in the phone book data.

15. A method of diagnosing an IEEE 802.15.1 function and a voice recognition function by interconnecting a vehicle terminal, which is a multimedia product assembled in a vehicle assembly plant with a vehicle diagnosis device, the method comprising steps of:

a) receiving, by the vehicle terminal, an inspection start command from the vehicle diagnosis device connected through an IEEE 802.11 dongle, and initiating a diagnosis mode;

b) detecting the vehicle diagnosis device and a Mac address stored in a system for diagnosing the vehicle terminal, requesting IEEE 802.15.1 pairing with the vehicle diagnosis device through the detected Mac address, and connecting the vehicle diagnosis device and the IEEE 802.15.1;

c) downloading and storing phone book data transmitted from the vehicle diagnosis device through IEEE 802.15.1 communication, and transmitting a phone book data reception completion message; and d) recognizing a phone book name spoken by the vehicle diagnosis device and searching for the recognized phone book name in the stored phone book data, and transmitting a result of a success of entrance to a call making mode by using a telephone number of the phone book name to the vehicle diagnosis device.

16. The method of claim 15, wherein step b) includes:

receiving and storing the Mac address through the inspection start command, and then searching for the vehicle diagnosis device.

17. The method of claim 15, wherein step d) includes:

entering a voice recognition standby mode when receiving a voice recognition inspection start command from the vehicle diagnosis device, and transmitting a voice recognition standby mode state to the vehicle diagnosis device.

18. The method of claim 15, wherein the phone book data includes the phone book name and the telephone number for at least one language.

19. The method of claim 15, wherein after step d), further comprising:

deleting, by the vehicle terminal, the stored phone book data for diagnosing the IEEE 802.15.1 and the voice recognition and removing a test trace.

20. The system of claim 14, wherein the multimedia product classification information includes audio, video, and navigation (AVN) information.

* * * * *